United States Patent [19]

Weyde et al.

[11] Patent Number: 4,458,009

[45] Date of Patent: Jul. 3, 1984

[54] PROCESS FOR THE PRODUCTION OF COLOR PHOTOGRAPHIC IMAGES AND PHOTOGRAPHIC RECORDING MATERIALS

[75] Inventors: Edith Weyde, Kuerten; Wilhelm Saleck, Bergisch Gladbach; Hubertus Psaar, Leverkusen; Anita von König, Krefeld; Hans Öhlschläger, Bergisch Gladbach, all of Fed. Rep. of Germany

[73] Assignee: Agfa-Gevaert Aktiengesellschaft, Leverkusen, Fed. Rep. of Germany

[21] Appl. No.: 456,971

[22] Filed: Jan. 10, 1983

[30] Foreign Application Priority Data

Jan. 20, 1982 [DE] Fed. Rep. of Germany ..... 3201557

[51] Int. Cl.[3] ..... G03C 5/16

[52] U.S. Cl. ..... 430/350; 430/390; 430/559; 430/566; 430/943

[58] Field of Search ..... 430/390, 391, 559, 943, 430/350, 566

[56] References Cited

U.S. PATENT DOCUMENTS

| | | | |
|---|---|---|---|
| 3,765,890 | 10/1973 | Weyde et al. | 430/943 |
| 3,776,730 | 12/1973 | Matejec et al. | 430/943 |
| 4,047,956 | 9/1977 | Blake | 430/559 |
| 4,065,312 | 12/1977 | Weyde et al. | 430/943 |
| 4,242,441 | 12/1980 | Nakamura et al. | 430/390 |
| 4,260,674 | 4/1981 | Weyde et al. | 430/943 |
| 4,315,986 | 2/1982 | Baralle et al. | 430/559 |

FOREIGN PATENT DOCUMENTS 1510470 5/1978 United Kingdom .

*Primary Examiner*—J. Travis Brown
*Attorney, Agent, or Firm*—Connolly & Hutz

[57] ABSTRACT

Color photographic images are produced by decomposing hydrogen peroxide on nuclei present in imagewise distribution and bleaching out a dye by the hydrogen peroxide on those parts of the image where no such nuclei are present.

17 Claims, No Drawings

PROCESS FOR THE PRODUCTION OF COLOR PHOTOGRAPHIC IMAGES AND PHOTOGRAPHIC RECORDING MATERIALS

This invention relates to a process for the dry production of colour photographic images by decomposing hydrogen peroxide on nuclei present in imagewise distribution, for example silver in silver images, and bleaching out a dye from those parts of the image where no such nuclei are present, and to recording materials suitable for this process.

The production of photographic images by decomposing peroxide compounds on the silver image is known and is used in the so-called "vesicular process". In this process, for example, a layer containing a photosensitive silver salt is exposed. Peroxide compounds may be decomposed on the image nuclei formed during exposure and processing. The image is made visible either physically by producing a vesicular image by expansion of the gas formed during decomposition or chemically by using the oxygen formed during decomposition for a dye-producing oxidation reaction.

U.S. Pat. No. 3,615,491 describes a process for the production of photographic images consisting of a silver image and a vesicular image superimposed thereon. In this process, a silver image is first conventionally produced in a hydrophilic layer, although it has considerably weaker coverage than the conventional black-and-white images normally produced. The layer is then brought into contact with hydrogen peroxide, the hydrogen peroxide being dcomposed to form oxygen gas bubbles at those areas where the silver is present imagewise in finely divided form. Under the effect of the subsequent heating of the exposed material, the gas released expands and a vesicular image is formed. Since the bubbles obtained scatter the light imagewise, these areas appear dark in transmitted light and light against a dark background when viewed in reflected light.

It is also known that the oxygen formed during the imagewise decomposition of hydrogen peroxide may be made visible chemically by utilisation for a dye-producing oxidation reaction rather than physically by bubble formation as described above. In this process, which is described in DE-OS No. 1,813,920, a photosensitive layer is exposed to produce nuclei of noble metals of the First and Eighth Secondary Group of the Periodic Table in imagewise distribution and subsequently treated with peroxide compounds, which decompose catalytically on the nuclei formed imagewise, in the presence of reaction components for a dye-producing oxidation reaction.

German Offenlegungsschrift No. 2,418,997 and British Pat. No. 1,510,470 describe a photographic material for the dry production of photographic images by the imagewise exposure of a photosensitive layer (either self-supporting or arranged on a layer support) which contains dispersed photosensitive silver salts which, on exposure, form catalysts for the decomposition of peroxide compounds, and subsequent treatment of the exposed layer with a peroxide compound to form a visible image, the photosensitive layer containing the silver salt in quantities of from 1 to 500 mg/m$^2$, the silver salt dispersion having a pAg below the equivalence point before casting, the particle size of the silver salt grains being smaller than 0.3 $\mu$m and the transparency of the photographic material amounting to at least 80%. In the case of this material, the decomposition of the peroxide compounds is catalysed by considerably finer silver.

The process just described gives high-definition black-and-white images characterised by very good contour definition.

The production of colour photographic images by bleaching out dyes with oxidising agents, particularly peroxides, is known.

There is a report in Brit. J. Phot., Vol. 52 (1905), page 608, on a colour process discovered by K. Schinzel which uses the destruction of dyes by oxygen formed through the decomposition of hydrogen peroxide on the silver image for the production of colour images. The reaction is carried out with an aqueous hydrogen peroxide solution. A negative dye image of the silver image is obtained. In Phot. Rundschau, pages 239–40, (1905), R. Neuhaus questions the practicability of this process which is also known as "Catachromisms". According to Neuhaus, the dyed silver gelatin layers bleach out uniformly, i.e. non-imagewise, on immersion in hydrogen peroxide solution and, during decomposition of the hydrogen peroxide on the image silver, gas bubbles are formed in the layer. This disadvantage is also described by K. Schinzel in Chemiker Zeitung Vol 32 (1908), page 667, as follows: "the method originally adopted by the author of using the catalytic decomposition of hydrogen peroxide by metallic silver for oxidising the dyes present in the exposed areas proved to be unworkable in practice because the gas bubbles formed in the layer destroy the image and the aniline dyes required are extremely unstable to light".

An object of the present invention is to provide a simple process for the production of coloured photographic images. A further object is to provide a suitable recording material.

A process has now been found for the production of positive coloured photographic images by exposing imagewise a photosensitive layer (either self-supporting or arranged on a layer support) containing a photosensitive compound which, after exposure, heat treatment or conventional photographic development, forms nuclei for the decomposition of hydrogen peroxide, this photosensitive layer or an adjacent layer or a layer separated from the photosensitive layer containing an oxidisable dye, and treating the exposed layer with hydrogen peroxide gas which is decomposed imagewise on the decomposition nuclei with or preferably without bubble formation, the dye being destroyed imagewise by subsequent heat treatment in the unexposed parts of the image, i.e. those parts of the image which do not contain decomposition nuclei, through the hydrogen peroxide which has not been decomposed in those areas. Silver halides are particularly suitable for use as the photosensitive compounds.

Furthermore, a photosensitive photographic material has been found containing at least one photosensitive layer which contains at least one silver halide dispersed in a hydrophilic binder, at least 50% of the silver halide grains having a maximum grain diameter of from 0.05 to 1 $\mu$m, wherein a dye capable of being bleached out with hydrogen peroxide is present in the photosensitive layer or in an adjacent layer.

The coloured images produced in accordance with the present invention are referred to as "positive" photographic coloured images because they are a positive of the image, for example the silver image, represented by the decomposition nuclei.

The process according to the present invention may be carried out with advantage by means of a photosensitive photographic material containing a silver halide emulsion layer with silver halide particles dispersed in a hydrophilic binder, at least 50% of the silver halide particles having a maximum particle diameter of from 0.05 to 1 μm, preferably from 0.05 to 0.6 μm, and optionally other layers, an oxidisable dye being present in the silver halide emulsion layer or in an adjacent layer.

In one particular embodiment of the process described above, it is possible to produce several coloured images from an original containing in imagewise distribution nuclei, preferably silver nuclei, for the decomposition of hydrogen peroxide, by initially charging the layer in question with hydrogen peroxide gas and subsequently bringing it into close contact with a layer, either self-supporting or arranged on a layer support, containing an oxidisable dye, the dye being destroyed by subsequent heating of the contacting layers over those areas which do not contain decomposition nuclei. After separation of the two layers, a positive image of the original is obtained. By repeating the process, it is possible to prepare several coloured images from the same original.

The dyes suitable for use in the process according to the present invention are not confined to those having a particular chemical structure. Virtually any dyes which react quickly with hydrogen peroxide gas on heating to form colourless products may be used.

In addition to triphenyl methane and indigoid dyes, suitable dyes are in particular methine dyes of the type comprehensively described in Ullmanns Enzyklopadie der technischen Chemie, 4th Edition, 1978, Vol. 16, pages 636 to 661. The methine dyes may be cationic methine dyes (strepto- and hemi-cyanines), styryl dyes, anionic (oxonols) or neutral (merocyanines) methine dyes and aza-analogues thereof. Some particularly suitable dyes are shown in the following Tables.

TABLE 1

| Compound No. | Triphenyl methane dyes Trade name | Colour index No. |
|---|---|---|
| 1. | Para rose aniline | 42500 |
| 2. | Malachite green | 42000 |
| 3. | Fuchsin | 42510 |
| 4. | Crystal violet | 42555 |
| 5. | Acilan light green SFG | 42095 |
| 6. | Acilan brilliant green 6B | 42100 |
| 7. | Acilan violet S4BN | 42640 |
| 8. | Astrarhodulin blue 6G | 42025 |
| 9. | Brillant Säureblau B | 42150 |
| 10. | Astraneufuchsin G | 42520 sulphonic acid |
| 11. | 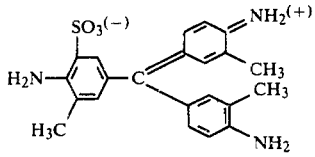 | |
| 12. | 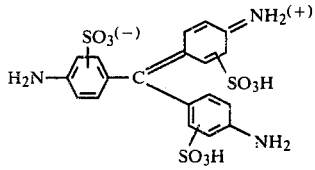 | |

TABLE 2

Indigoid Dyes

| Compound No. | Trade Name | Colour Index No. |
|---|---|---|
| 13. | Indanthrene print blue 2G | 73800 |
| 14. | Anthrasol print blue 1GG | 73801 |
| 15. | Indigo carmine | 1180 |

TABLE 3

Anionic Methine Dyes (oxonols)

| Compound No. | Formula | Literature |
|---|---|---|
| 16. | 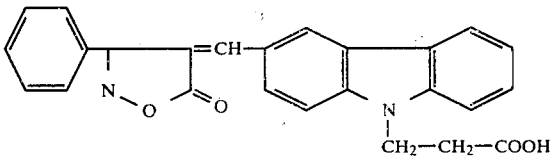 | |
| 17. | 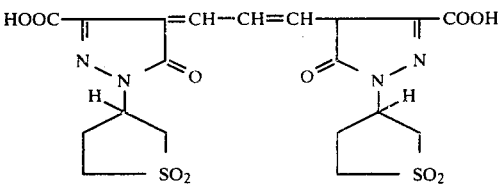 | DE-OS No. 2,453,217 |

Compounds corresponding to the following general formula produced in accordance with U.S. Pat. No. 2,036,456:

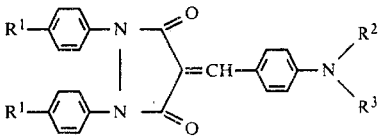

Compound

TABLE 3-continued
| Anionic Methine Dyes (oxonols) | | | |
|---|---|---|---|
| No. | $R^1$ | $R^2$ | $R^3$ |
| 18. | H | $CH_2—COOH$ | $CH_2—COOH$ |
| 19. | H | $CH_3$ | $CH_2—COOH$ |
| 20. | $SO_3H$ | $CH_3$ | $CH_2—COO—C_{10}H_{21}$ |
Compounds corresponding to the following general formula:
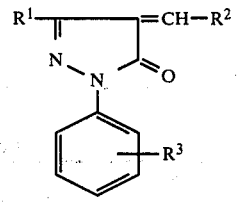
| Compound No. | $R^1$ | $R^2$ | $R^3$ |
|---|---|---|---|
| 21. | $CH_3$ | 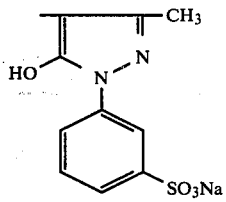 | 3-$SO_3Na$ |
| 22. | $CH_3$ | 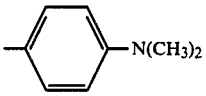 | 4-$SO_3H$ |
| 23. | $C_{14}H_{23}$ | 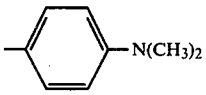 | 4-$SO_3H$ |
| 24. | —COOH | 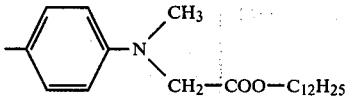 | 4-$SO_3H$ |
| 25. | $NH—CO—C_{11}H_{23}$ | 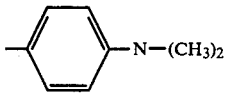 | 3-$SO_3H$; 4-$O—C_6H_5$ |
| 26. | —COOH | 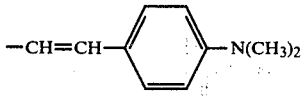 | 3-$NH—CO—$ 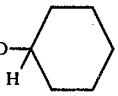 |
| 27. | $C_{17}H_{35}$ | 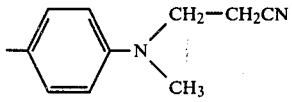 | 4-$SO_3H$ |
| 28. | $C_{17}H_{35}$ | 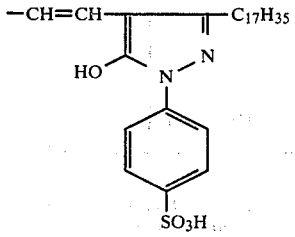 | 4-$SO_3H$ |

TABLE 3-continued

Anionic Methine Dyes (oxonols)

| | | |
|---|---|---|
| 29. | $C_{17}H_{35}$ | 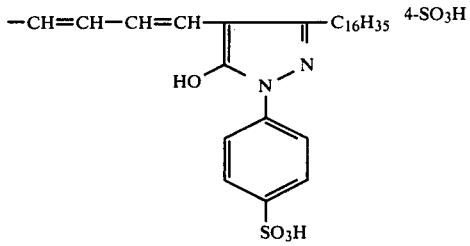 |

The production of compounds 28 and 29 is described in DE-AS No. 1,130,697. The other oxonols may be obtained in known manner, for example by the processes described in DE-OS No. 2,453,217, in U.S. Pat. No. 2,036,546 and in DE-AS No. 1,130,697.

TABLE 4

Cationic Methine Dyes

| Compound No. | Trade Name or Formula | Colour Index No. or Literature |
|---|---|---|
| Hydrazine dyes | | |
| 30. | 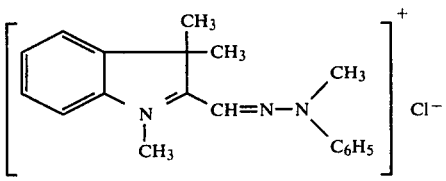 | DE-AS No. 1,083,000 |
| Zero-Methine Dyes | | |
| 31. | 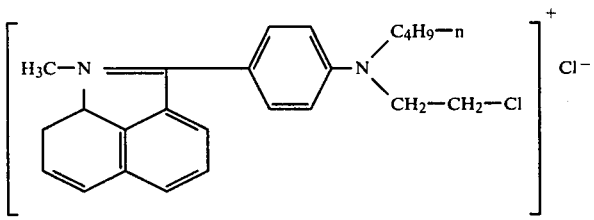 | DE-AS No. 1,190,126 |
| Styryl Dyes | | |
| 32. | Astrazon red 6B | 4 8020 |
| 33. | 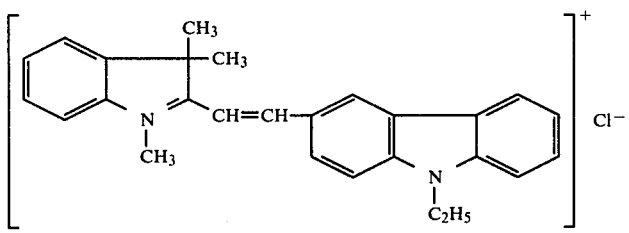 | German Patent 835,172 |
| 34. | 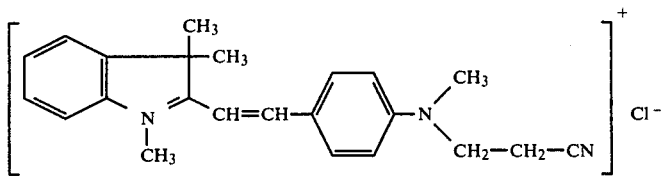 | German Patent 721,020 |

TABLE 5

Cyanine Dyes

Compounds corresponding to the following general formula:

TABLE 5-continued

| Compound No. | Trade Name or formula | Colour Index No. or Literature |
|---|---|---|
| Zero-Methine Cyanine Dyes | | |

TABLE 5-continued

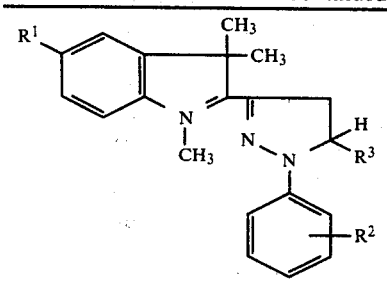

U.S. Pat. No. 4,138,570

| No. | $R^1$ | $R^2$ | $R^3$ |
|---|---|---|---|
| 35 | Cl | 4-$CH_3$ | $CH_3$ |
| 36 | —$OCH_3$ | 4-$OCH_3$ | $CH_3$ |
| 37 | H | 2,5-Cl, 4-CN | H |
| 38 | 5-Br | 4-$OCH_3$ | $CH_3$ |
| 39 | H | 2-Cl | H |
| 40 | H | 2,6-Cl | $CH_3$ |
| 41 | H | 2-$CH_3$, 6-Cl | $CH_3$ |
| 42 | Cl | 2,6-Cl | $CH_3$ |

TABLE 6

Aminoaryl neutrocyanines

| Compound No. | Trade Name or Formula | Literature |
|---|---|---|
| 43. | 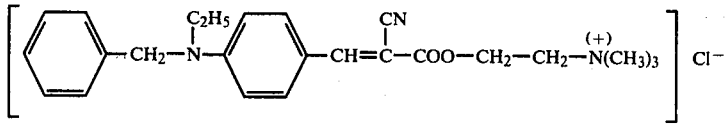 | DE-AS No. 2,714,653 |
| 44. | 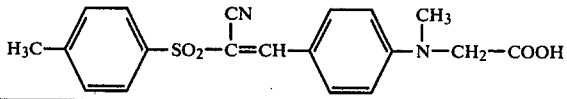 | |

The appropriate dyes may be determined by the following test. The dyes are added in quantities of from 0.05 to 1 g/m² to a gelatin layer of 8 g/m².

This layer is charged for from 10 to 60 seconds (depending on the type of apparatus) with hydrogen peroxide gas released, for example, from percarbamide by heating to from 40° to 70° C. The dye has to be bleached out completely irreversibly by heating for from 3 to 20 seconds to from 100° to 150° C., depending on the type of apparatus used.

This bleaching out of the dyes may be combined with the silver image of a photographic material. If an imagewise silver layer, for example photolytic silver after heating, heat-developed silver or silver developed by wet processing in the conventional way is charged with hydrogen peroxide gas for from about 10 seconds to 2 minutes and then brought into close contact with one of the dye layers described above and the resulting layer combination heated for a few seconds to from 100° to 150° C., a coloured image is formed in the dye layer.

A vesicular image is formed by catalytic decomposition of the hydrogen peroxide on the silver to form water and oxygen and the hydrogen peroxide is used up. The hydrogen peroxide is not consumed on those parts of the image which are free from silver and migrates into the dyed layer where it bleaches out the dye. Bleaching out only takes place when the two layers are heated, being completed in a matter of seconds. This is essential to the definition of the dye image.

The dye may also be added to the silver halide layers or to an adjacent layer. In this connection, it is preferable to add a developer substance to layers of this type so that the layers may be developed by heating after exposure. The conditions prevailing during treatment with the hydrogen peroxide gas and subsequent heating may be varied in such a way that either a vesicular image plus a dye image is obtained on the silver image areas or alternatively a dye image is obtained without a vesicular image.

When hydrogen peroxide acts on metallic silver, two different reactions may take place. Hydrogen peroxide is capable of oxidising silver or alternatively the silver catalyses the decomposition of the hydrogen peroxide into water and oxygen. If it is desired to obtain a vesicular image without a dye image, a fairly considerable amount of hydrogen peroxide is required. If the quantity of hydrogen peroxide is reduced to such an extent that bubbles are still just formed, a dye image is also obtained at the same time. If the quantity of hydrogen peroxide is reduced even further no more bubbles are formed and a pure dye image is obtained. Oxidation of the silver and bleaching out of the dye required substantially stoichiometric quantities of hydrogen peroxide while bubble formation involves a catalytic process. Two conditions have to be satisfied for the success of this process. Firstly, the quantity of silver in the photographic material has to be very small. Secondly, the dyes are required to have a high intensity of colour so that sufficiently dense coloured images are obtained despite the small quantities of silver. For example, a vesicular image is formed with a gassing time of 120 seconds and a gassing temperature of approximately 50° C. while a coloured image is obtained with a gassing time of from 10 to 20 seconds and a gassing temperature of approximately 45° C. The gassing times and temperatures depend upon the type of gassing apparatus used.

The conditions which are favourable to the formation of a coloured image or a vesicular image are different. The formation of bubbles is a mechanical problem. Presumably, so-called "microbubbles" still not visible are actually formed during the gassing treatment, expanding to a considerable extent and coalescing to form relatively large bubbles during the subsequent heat treatment. Accordingly, the greater part of the vesicular image is formed between the silver particles. Only sufficiently thermoplastic layers enable the microbubbles to coalesce. Thus, an unhardened or only slightly hardened gelatin layer is highly thermoplastic at elevated temperatures, the water formed during decomposition of the hydrogen peroxide playing a part. Gelatin layers which have been hardened to a greater extent are less thermoplastic on heating and, because of this, complicate bubble formation and are therefore suitable for the formation of a coloured image. For the formation of a coloured image in a material containing silver and dye, it is necessary to select conditions under which the silver image is destroyed as completely as possible by oxidation. Dissolution of the silver may be accelerated by certain substances, for example by alkali metal halides and acids.

Mixtures of various dyes may also be added to the coloured layers.

Suitable hydrophilic binders in which the photosensitive compounds, i.e. preferably silver halides, are present are the conventional water-permeable and hydrophilic film-formers, for example natural binders, such as proteins, particularly gelatin, cellulose and derivatives thereof, such as cellulose esters or ethers, for example cellulose sulphate, carboxymethyl cellulose or $\beta$-hydroxy-ethyl cellulose, alginic acid or derivatives thereof, such as esters, salts or amides, starch or starch derivatives, carraghenates. Photosensitive silver salts of which the latent image nuclei catalyse the decomposition of hydrogen peroxide after heating, thermal development or conventional processing or may be oxidised by hydrogen peroxide are particularly suitable for the process according to the present invention. In the context of the present invention, salts may be any silver salts of inorganic and organic acids in the broadest sense providing they produce a latent image by actinic light. On account of the high sensitivity to light generally required, silver halides are preferably used. The silver halide used may be silver chloride, silver bromide and mixtures thereof, even with silver iodide in a molar proportion of up to 10%.

However, it is also possible to use other silver salts, for example silver salts of organic carboxylic acids, particularly long-chain carboxylic acids, or silver salts of thioether-substituted aliphatic carboxylic acids, as described in U.S. Pat. No. 3,330,863. It is also possible to use silver salts of polybasic, aliphatic carboxylic acids, such as silver oxalate, silver salts of inorganic acids, such as silver phosphate, or even silver salts of organic compounds. Silver salts of sensitising dyes of the type described in German Offenlegungsschrift No. 1,472,870 are particularly suitable.

For steep, relatively insensitive materials, of the type used, for example, for copying purposes, silver halide emulsions of the type described in German Offenlegungsschrift No. 2,418,997 will be used. Other fine-grained silver halide emulsions having a narrow particle size distribution are of course also suitable for this purpose.

Fine-grained emulsions are particularly suitable for dry processing because the latent image nuclei of coarse-grained emulsions cannot be intensified to a significant extent, if at all, by development at elevated temperature.

In addition to the conditions for sensitivity, gradation and stability which the silver halide emulsions have to satisfy for the purposes of the process according to the present invention, the crucial properties are:

complete freedom from fogging of the emulsion, a maximum average particle size of the order of about 0.6 $\mu$m should not be exceeded to a significant extent to ensure that the silver halides may be effectively heat developed, the heat-developed silver particles should be so small that they may be changed to the point of invisibility by the treatment with hydrogen peroxide, i.e. no visible silver fog should remain behind at the end of the overall processing cycle, the unexposed silver halide crystals should be inactivated as far as possible against light by the heat treatment.

Preferably, the photosensitive layers according to the present invention have a relatively low silver content (expressed as silver nitrate) of not more than 400 mg/m$^2$, preferably from 150 to 300 mg/m$^2$, for a layer thickness of from 2 to 15 $\mu$m, preferably from 5 to 10 $\mu$m.

The grain size of the silver salt in the photosensitive layers of the material according to the present invention is relatively small and, in general, is less than 0.6 $\mu$m, preferably less than 0.1 $\mu$m.

The production of the silver salts is preferably carried out in the presence of a suitable peptising agent. Suitable peptising agents are, for example, gelatin, particularly photographically inert gelatin, cellulose derivatives, such as cellulose esters or ethers, for example cellulose sulphate, carboxy-methyl cellulose or cellulose acetates, particularly cellulose acetates having a degree of acetylation of up to 2, and synthetic polymers, such as polyvinyl alcohols, partially hydrolysed polyvinyl esters, for example partially hydrolysed polyvinyl acetate, polyvinyl pyrrolidone.

Particularly suitable peptising agents for relatively high and very high photosensitive levels, as required for recording materials, are copolymers containing recurring 8-oxyquinoline units, the proportion of the 8-oxyquinoline structure in the copolymer amounting to from 0.1 to 20%, by weight, preferably from 0.1 to 10%, by weight. Suitable comonomers are primarily water-soluble comonomers. In some cases, it may also be advantageous to incorporate other less readily water-soluble polymerisable monomers.

Copolymers obtained by the polymerisation of 8-oxyquinoline-containing acrylic acid derivatives with acrylamide, acrylic acid and/or N-vinyl pyrrolidone have proved to be particularly useful. Suitable copolymers are described, for example in German Offenlegungsschrift No. 2,407,307.

To obtain maximum photosensitivity, the silver halide emulsions may be prepared by converting fine-grained silver phosphate with halide. They may also be prepared in known manner by combining an aqueous solution of a halide and silver nitrate. This may be done, for example, by the double jet method. In this respect, the concentration of silver ions may be relatively high, as in German Offenlegungsschrift No. 2,418,997, although the silver ion concentrations may also be relatively low.

In addition, the silver halide emulsions may contain $Co^{2+}$, $Ce^{3+}$, $Ce^{4+}$, $Cu^{+}$ or $Cu^{2+}$-salts in order to obtain particularly high sensitivity levels.

The silver halide dispersions may also be chemically sensitised, for example with reducing agents, such as tin(II)-salts, polyamines, such as diethylene triamine, sulphur compounds of the type described in U.S. Pat. No. 1,574,944 or in MEES's book entitled "Theory of the Photographic Process" (1954), pages 149 to 161. The emulsions may also be chemically sensitised with salts of noble metals, such as ruthenium, rhodium, palladium, iridium, platinum or gold, as described in the article by R. Koslowsky in Z. Wiss. Phot. 46 (1951), pages 65 to 72. Other suitable chemical sensitisers are compounds of the thiomorpholine series, for example those described in French Pat. No. 1,506,230, or even polyalkylene oxides, particularly polyethylene oxide and derivatives therof.

The silver halide dispersions may also be optically sensitised, for example with the conventional polymethine dyes, such as neutrocyanines, basic or acid carbocyanines, mero- or rhoda-cyanines, hemi-cyanines, styryl dyes, oxonols and the like. Sensitisers of this type are described in F. M. Hamer's book entitles "The Cyanine Dyes and Related Compound" (1964).

Where hardenable binders are used for dispersing the silver salts, they may be hardened in the conventional way, for example with formaldehyde or with halogen-substituted aldehydes containing a carboxyl group, such as mucobromic acid, diketones, methane sulphonic acid esters, dialdehydes and the like. Carboxyl group-activating cross-linking agents producing peptide bonds, for example carbodiimides and carbamoylonium compounds, are particularly suitable for the heat-developable layers.

In order to improve the stability of the image nuclei and photosensitivity, the materials according to the present invention may contain known compounds capable of acting as halogen-acceptors, such as silver salts, reducing agents and developer substances. The developer substances also act as developer substances during the heat treatment of the exposed material and may be contained in a photosensitive or non-photosensitive layer.

The positive effect of compounds of the type in question is attributable to the fact that the halogen formed in the primary reaction during exposure is intercepted. This prevents the latent silver image nuclei from being destroyed by the halogen.

Suitable compounds are, for example, silver salts, such as silver oxalate, silver phosphate, silver-(3-carboxylatomethylthio)-1,2,4-triazole, silver-(3-carboxalatomethylthio)-5-amino-1,2,4-triazole, silver-(2-carboxylatomethylthio)-5-amino-1,3,4-thiadiazole, silver-(2-carboxylatomethylthio)-5-anilino-1,3,4-thiadiazole, silver-(2-carboxylatomethylthio)-benzimidazole, di-silver-[3,5-bis(carboxylatomethylthio]-1,2,4-triazole, N-(N-tosyl-N'-phenylurea)-silver, N-(N-3-amino-4-hydroxybenzoylsulphonyl-N-benzene-sulphonimide)-silver, N-(1,2-benzisothiazolyl-3-one)-silver, silver-(2-carboxymethylthio-4-methyl)-quinoline, di-silver-(1,2-bis-carboxylatomethylthio)-ethane, N-benztriazolyl silver and silver salts of the following compounds:

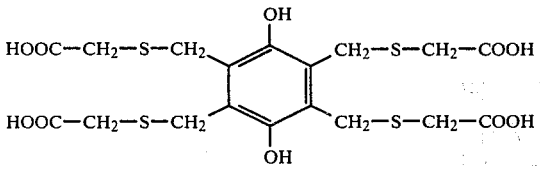

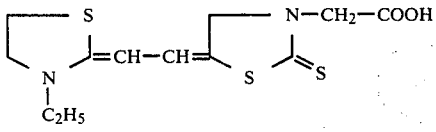

-continued

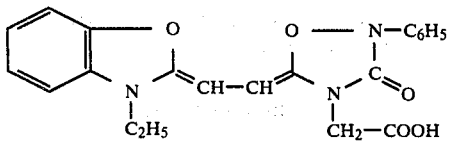

In addition, a stabilising and, hence, photosensitivity improving effect is shown by such reducing agents as hydrazines and derivatives thereof, substituted hydrazines, acylated hydrazines, particularly hydrazides, and by aminophenols, amino-substituted benzene compounds, particularly phenylene diamine and substitution products thereof and, for example, the following compounds:

Hydrazides

Tartaric acid dihydrazide, malonic acid dihydrazide, malic acid dihydrazide, mucic acid dihydrazide, citric acid trihydrazide.

Polyamines

Diethylene triamine.

Hydroxylamine derivatives

N-ethyl-N'-hydroxy urea, N-phenyl-N'-hydroxyurea, N-hydroxy urea, N-hydroxy benzamide, N-hydroxy carbamic acid ethyl ester.

Phenols

Pyrocatechol, hydroquinone, 1,4-dihydroxy phthalimide, DL-d-methyl-β-(3,4-dihydroxyphenylalanine), homogentisic acid, homogentisic acid amide, 2,5-(dihydroxyphenyl)-5-(1-phenyltetrazolyl)-sulphide.

Phenylene diamines

N,N-diethyl-N'-sulphomethyl-p-phenylene diamine, N,N-dimethyl-N'-sulphomethyl-p-phenylene diamine, 3-methyl-4-sulphomethylamino-N,N-diethylene aniline.

3-pyrazolidones 1-phenyl-3-pyrazolidone, 1-m-toluene-3-pyrazolidone, 1-p-tolyl-3-pyrazolidone, 1-phenyl-4-methyl-3-pyrazolidone, 1-phenyl-5-methyl-3-pyrazolidone, 1,4-dimethyl-3-pyrazolidone, 4-methyl-3-pyrazolidone, 4,4-dimethyl-3-pyrazolidone, 1-phenyl-2-acetyl-3-pyrazolidone, 1-phenyl-4,4-dimethyl-3-pyrazolidone, 1-(4-bromophenyl)-3-pyrazolidone, 1-p-tolyl-4-hydroxymethyl-4-methyl-3-pyrazolidone, 1-phenyl-4-hydroxymethyl-4-methyl-3-pyrazolidone.

The above compounds are added to the photographic layer before casting. The concentration thereof may vary within wide limits and is determined by the effectiveness of the compound and by the required purpose. In general, concentrations of from 10 to 500 mg per liter, preferably from about 50 to 200 mg per liter, of casting solution (corresponding to a concentration of from 1 to 50 mg/m$^2$ of material) and, for the developer substances, quantities of from 1 to 10 g/l preferably, from 4 to 7 g/l, of casting solution (corresponding to 0.1 to 1 g/m$^2$) have proved to be advantageous.

The above compounds by which stability and photosensitivity are improved may also be used in admixture with one another. Optimal combinations may be determined without difficulty by simple laboratory tests.

To improve stability in storage and heat development the layers according to the present invention may contain dispersates containing known so-called "hydrophilic" oil-formers. Such oil-formers and dispersates are described inter alia in DE-OS No. 1,772,192.

These oil formers preferably correspond to the following general formula:

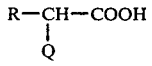

wherein

R represents a saturated or olefinically unsaturated, aliphatic hydrocarbon group containing from 1 to 18 carbon atoms;

Q represents —COX or —$CH_2$COX wherein X may represent:

(1) H, OH, alkoxy, cycloalkoxy, (2) the group -0-alkylene-[0-alkylene]$_n$-0-alkyl wherein n=0–10, (3) an amino, (4) hydrazino or (5) hydroxylamino group, the substituents mentioned being in turn substituted or unsubstituted.

The substituent Q represents in particular the radical —$CH_2$COX.

X preferably represents an optionally substituted alkoxy or cycloalkoxy radical, more particularly a radical corresponding to the following formula:

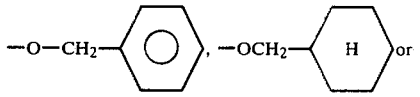

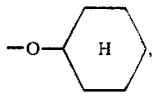

the phenyl ring and the cyclohexane ring optionally being further substituted, for example by a radical derived from succinic acid or from a succinic acid monoester. The following hydrophilic oil-formers are particularly suitable:

TABLE 7

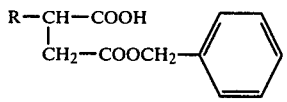

(1)

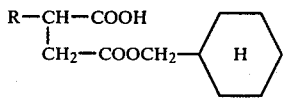

(2)

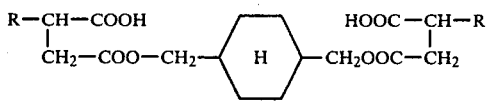

(3)

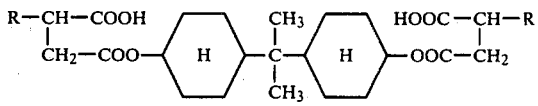

(4)

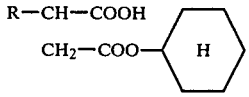

(5)

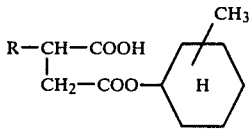

(6)

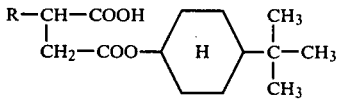

(7)

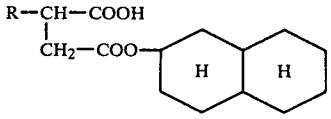

(8)

TABLE 7-continued

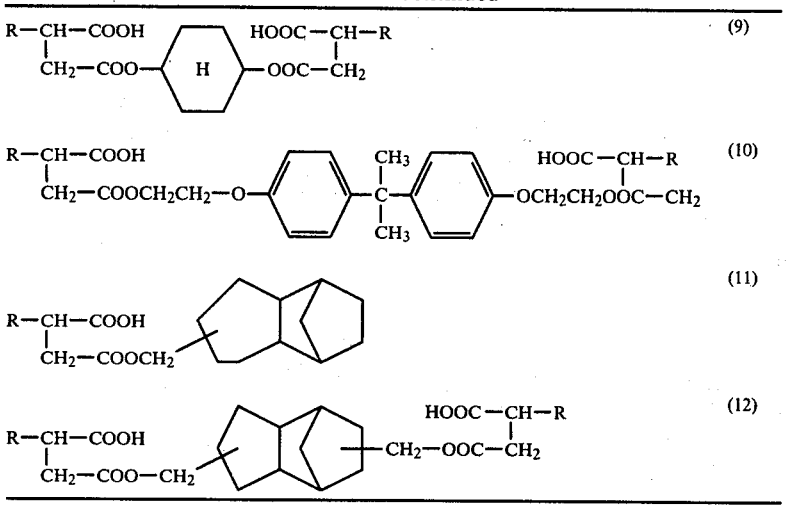

In the above formulae 1 to 12, the symbol R represents a relatively long aliphatic radical containing at least 8 carbon atoms, preferably one of the following monounsaturated aliphatic radicals:
$-C_{12}H_{23}$, $-C_{15}H_{29}$ or $-C_{18}H_{35}$.

In addition, N,N-diethyl lauroyl amide, phosphoric acid-, adipinic acid- and phthalic acid esters may be used as an oil-former. Especially preferred are tricresyl-, triphenyl-, and trioctylphosphate, diisononyl adipate and dinonylphthalate.

In one particularly advantageous embodiment, developer substances, particularly 3-pyrazolidones, are added to the dispersion and the resulting mixture added to the casting solution before casting. The dispersions are used in quantities of from 10 to 100 g/l, preferably from 40 to 80 g/l, of casting solution corresponding to a concentration of from 1 to 10 g/m$^2$. The dispersions containing from 50 to 200 g, preferably from 70 to 170 g, of oil-former per kg of dispersate.

To improve the stability thereof in storage, the emulsions according to the present invention may contain known oxidation inhibitors, such as alkali metal sulphite, bisulphite, addition products of aldehydes and ketones, preferably cycloalkyl ketones, more particularly cyclohexanone bisulphite.

The photographic materials may contain the conventional stabilisers, such as tri- or tetra-azaindolizines, particularly those substituted by at least one hydroxyl and/or amino group. Indolizines of this type are described, for example in the article by BIRR in Z. Wiss Phot. 47 (1952), pages 2 to 58 and in U.S. Pat. No. 2,944,901. In addition, it is possible to use benzotriazoles or heterocyclic mercapto compounds, for example 3-mercapto-4-amino-1,2,4-triazole, 3-mercapto-4-(p-sulphonic acid-phenylamino)-5-methyl-1,2,4-triazole.

The photographic materials may contain the substances normally used for improving the evolution of heat in heat development processes, i.e. substances which release water at elevated temperature, or hydrophilic compounds which increase the residual moisture of the layer. Substances of the first type are, for example, ureas, caprolactams, $\beta$-nitroethanols or $\beta$-cyanoethanols and salts which form defined hydrates, such as sodium acetate, sodium citrate or sodium sulphate.

Substances of the second type are polyalcohols and mono- and oligo-saccharides. One advantage of the saccharides in that, in addition to the effect thereof as described in German Pat. No. 1,174,157, they are oxidised by hydrogen peroxide during heat development to form acids, thereby reducing the pH of the processed layers. The discolouration of the images in light, which is often observed, is prevented by this reduction in the pH by the acids formed, for example saccharic acids.

In addition, the materials according to the present invention may contain the intermediate layers described in German Pat. No. 1,189,383 or a cellulose sulphate intermediate layer between the support and the emulsion layer.

Known layer supports for photographic materials are suitable for the material according to the present invention. Such layer supports include, for example, films of cellulose esters, polyesters based on polyethylene terephthalic acid ester or polycarbonates, particularly based on bisphenol A, and also paper supports, for example baryta paper. It is of course important when selecting suitable layer supports to ensure that they are stable at the processing temperature.

Basically, the material according to the present invention may be used in known processes for the production of photographic images by imagewise exposure and the decomposition of peroxide compounds. Such processes include processes in which the decomposition of a peroxide compound takes place on relatively coarse nuclei of metallic silver formed after exposure and photographic development. However, the material according to the present invention is particularly suitable for a process in which imagewise exposure is followed by a first heat treatment before the treatment with a peroxide to be decomposed. This is done simply by heating to temperatures preferably in the range of from 80° to 130° C. The heating time may vary within wide limits and is generally from 2 to 30 seconds.

This is followed by the treatment of the material according to the present invention with a peroxide compound in known manner. The simplest way of doing this is to charge the exposed layer with hydrogen peroxide gas while heating. The most suitable substances for this purpose are hydrogen peroxide or compounds which give off hydrogen peroxide on heating, for example percarbamide and the materials mentioned in German Offenlegungsschrift No. 2,420,521.

After the gassing treatment with hydrogen peroxide, the material according to the present invention is heated for a few seconds to temperatures of from 80° to 150° C. to bleach out the dyes and to oxidise the silver image or to produce bubbles. Heating may be carried out by means of heatable presses, drying cylinders, rollers or the apparatus described in Belgian Pat. No. 628,174 or in French Pat. Nos. 1,512,332; 1,416,752 or 1,419,101 and also in conventional commercial apparatus.

EXAMPLE 1

Production of a coloured image using a conventionally processed photographic layer

Photosensitive material 60 ml of a fine-grained silver bromide iodide emulsion (grain size 0.05 μm) containing 3 mole percent of iodide, having a silver (expressed a silver nitrate to gelatin ratio of 0.8 and having a silver content (expressed as silver nitrate) of 43.65 g/kg of emulsion are added to 1 liter of an 8% gelatin solution.

10 ml of a 1% sodium lauryl sulphate solution are then added and the pH adjusted to from 5.7 to 5.8 by the addition of borax solution.

The emulsion is applied to a cellulose acetate support with a silver coating corresponding to 0.25 g of silver nitrate per $m^2$ and 7.9 g of gelatin per $m^2$. A 1% gelatin solution, to which 13.5 g/l of the following hardener:

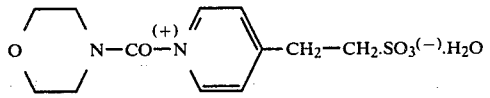

and 0.5 g/l of the wetting agent, tetraethyl ammonium perfluorooctane sulphonate, dissolved in water, had been added, is applied to the emulsion layer in a layer thickness of 2 g of gelatin per $m^2$.

After exposure to form an image, the layer is developed for 1 minute at 20° C. in a developer having the following composition:

1 g of p-methyl aminophenol
3 g of hydroquinone
13 g of sodium sulphite sicc.
26 g of sodium carbonate sicc.
1 g of potassium bromide
made up with water to 1 liter.

The material is then fixed with an aqueous sodium thiosulphate bath, rinsed and dried in the conventional way. On account of the thin silver coating, a faint silver image is obtained.

Dye layer

One of the dyes listed in Table 8 below is added either in the form of a solid or in solution in water to 1 liter of a from 6 to 8% gelatin solution. After the dyes have dissolved, the gelatin solution is applied to a cellulose acetate support in a layer thickness of from 6 to 8 g/$m^2$ of gelatin. The gelatin layer is hardened in the same way as the above emulsion layer.

Processing

The silver image of the processed photosensitive material is treated with hydrogen peroxide gas and then heated for a few seconds at from 100° to 130° C. in close contact with a dye layer.

The hydrogen peroxide is catalytically decomposed on the silver image of the photographic material, resulting in the formation of vesicles. The hydrogen peroxide gas which has not been decomposed diffuses into the dye layer over the silver-free areas of the image and bleaches out the dye. The silver image of the photographic material is considerably intensified by the vesicles and the dye image corresponds to the silver image. In terms of the photograph, therefore, a colour negative is obtained from a silver negative and a colour positive from a silver positive.

The quantity of hydrogen peroxide gas used is determined by the requirement that the dye has to be completely bleached out over the silver-free areas of the image. Where percarbamide is used as donor for the hydrogen peroxide gas, it is heated to from 45° to 50° C. and the silver image treated for from about 1 to 2 minutes with hydrogen peroxide gas.

100 $cm^2$ of the above layers require from approximately 0.01 to 0.1 g of hydrogen peroxide gas which is obtained by heating the percarbamide to from 45° to 50° C. over a period of from 1 to 2 minutes.

Where conventional commercial photographic materials are used instead of the photographic material described above, the processing conditions have to be adapted accordingly. In most cases, very faint silver images (underexposure) may be processed in the same way as described above. In the case of silver images, containing much silver, it is possible particularly if the layers have been thoroughly hardened, thereby impairing vesicle formation to produce several colour prints from the same film for a generally somewhat longer gas treatment time. To this end, the gas treatment and heating with the dye layers will be repeated several times in succession. Any silver fog present has a considerable bearing upon the duration of the gas treatment.

TABLE 8

| Dyes of Tables 1 to 6 Compound No. | g/l of gelatin solution | Colour |
|---|---|---|
| 2 | 7 | green |
| 3 | 5 | red |
| 4 | 4 | violet |
| 5 | 6 | green |
| 6 | 6 | green |
| 7 | 5 | violet |
| 8 | 5 | blue |
| 9 | 7 | blue |
| 10 | 6 | red |
| 15 | 5 | blue |
| 17 | 7 | red |
| 19 | 6 | yellow |
| 20 | 6 | yellow |
| 24 | 5 | yellow |
| 26 | 7 | yellow |
| 29 | 7 | blue |
| 31 | 5 | blue |
| 33 | 6 | red |
| 34 | 7 | red |
| 38 | 5 | red |
| 43 | 6 | yellow |

EXAMPLE 2

Production of a coloured image using a heat-developed photographic layer

Photosensitive material 60 ml of a very fine-grained silver bromide iodide emulsion (grain size 0.05 μm) containing 3 mole percent of iodide and having a silver (expressed as silver nitrate) to gelatin ratio of 0.8 and a silver (expressed as silver nitrate) content of 43.65 g/kg of emulsion are added to 1 liter of an 8% gelatin solution. 10 ml of a 1% sodium lauryl sulphate solution are then added and the pH adjusted to from 5.7 to 5.8 by the addition of borax solution. Finally, 6 g of 1-phenyl-4-hydroxy methyl-4-methyl-3-pyrazolidone are added as developer substance.

The emulsion is applied to a cellulose acetate support with a silver coating corresponding to 0.25 g of silver nitrate per $m^2$ and 7.9 g of gelatin per $m^2$. The emulsion is hardened in the same way as described in Example 1.

After exposure to form an image, the layer is developed for from 10 to 20 seconds at 130° C. The colour images are then formed in the same way as described in Example 1. Compared with the process described in Example 1, the colour images are obtained very quickly by dry processing.

EXAMPLE 3

Production of a colour image in the silver halide layer

The dyes may also be added to the silver halide emulsion. Since the dyes considerably reduce photosensitivity in the absorption range thereof, this reduction has to be corrected by the addition of corresponding sensitisers.

Since some effectively bleachable dyes fog and/or desensitise the silver halide emulsion, only some of the dyes mentioned in Tables 1 to 6 may be used as an emulsion additive.

Photosensitive material A 6.5 g of dye No. 9, Acilan turkey blue B, are dissolved in 1 liter of an 8% gelatin solution. 60 ml of a very fine-grained red-sensitised silver bromide iodide emulsion (grain size 0.05 μm) containing 3 mole percent of iodide and having a silver (expressed as silver nitrate) to gelatin ratio of 0.8 and a silver content (expressed as silver nitrate) of 43.65 g/kg of emulsion are added to this gelatin solution. Following the addition of 10 ml of a 1% sodium lauryl sulphate solution and adjustment of the pH to from 5.7 to 5.8 by the addition of borax solution, 6 g of 1-phenyl-4-hydroxy methyl-4-methyl-3-pyrazolidone are added as developer substance.

The emulsion is applied to a cellulose acetate support with a silver coating corresponding to 0.25 g of silver nitrate per $m^2$, 7.9 g of gelatin and 0.6 g of dye per $m^2$.

A 0.1% aqueous cellulose sulphate solution (Kelco SCS/MV a product of the Kelco Comp. San Diego), to which 0.5% of the hardener mentioned in Example 1 had been added, is applied to the emulsion layer in a wet layer thickness of 60 μm.

After exposure to form an image, the layer is developed for from 10 to 20 seconds at from 120° to 130° C. In order to obtain a pure dye image without vesicles, the quantity of hydrogen peroxide gas added has to be reduced to about one tenth in relation to Example 1, i.e. the gas treatment time has to be considerably shortened. Where percarbamide is used as the hydrogen peroxide donor, it is only heated to from 40° to 45° C. and the silver image treated with hydrogen peroxide gas for from about 10 to 20 seconds. Under these conditions, the hydrogen peroxide oxidises the silver on subsequent heating of the layer at from 100° to 130° C. and does not bleach out the dye over these areas of the image. A pure blue, vesicle-free dye image is obtained. Instead of 6.5 g of Acilan turkey blue B, the following dyes may also be added to the emulsion:

5 g of dye No. 33, Astra red 3G or
5 g of dye No. 7, Acilan violet S4BN or
7 g of dye No. 20 to 1 liter of 8% gelatin solution.

Instead of a red-sensitised emulsion, it is necessary to use an optical sensitiser corresponding to the absorption ranges of the dyes.

Dye No. 13, Indanthren print blue 2G, has proved to be a very effectively bleachable dye which is known to show excellent fastness to light. Since this dye is very sparingly soluble in water, it is preferably introduced into gelatin solution by way of its water-soluble leuco compound, dye No. 14 (Anthrasol print blue IGG). In order to obtain a very fine distribution of the dye, 10 g of dye No. 14 are dissolved in 1 liter of an 8% gelatin solution which is then exposed to sunlight in a very large tray. The leuco compound is very quickly converted into a blue dye under the effect of the light. On completion of the reaction, the gelatin is rinsed out and the resulting gelatin solution used instead of the gelatin solution containing 6.5 g of Acilan turkey blue B. A blue, light-stable, vesicle-free dye image is obtained after processing.

Oxidation of the image silver may be accelerated by the addition of 0.1 g of potassium bromide/kg to the emulsion and/or by a somewhat lower pH of the emulsion of from 5.4 to 5.5.

Instead of using the silver bromide iodide emulsion mentioned above, it is also possible to use the following emulsions.

Where the following emulsions are used, the residual moisture of the layer is reduced by heat treatment to such an extent that the latent image nucleus is not destroyed too quickly by the hydrogen peroxide.

Use of an emulsion having a pAg below the equivalence point of which the production is described in DE-OS No. 2,418,997

Photosensitive material B

Preparation of the emulsion 10 ml of a 5% aqueous solution of potassium bromide are added dropwise to a mixture of 250 ml of a 10% aqueous solution of inert gelatin and 50 ml of a 2% aqueous solution of silver nitrate. The emulsion is hardened in the conventional way. It has a pAg of 3.75. The silver bromide grains have an average grain diameter of 0.015 μm. The emulsion is then further processed in the same way as the silver bromide iodide emulsion of the photosensitive material A, but without the addition of developer substance. Since the emulsion forms enough active nuclei (by comparison with hydrogen peroxide) after exposure and heating, even in the absence of developer substance, the 1-phenyl-4-hydroxy methyl-4-methyl-3-pyrazolidone does not have to be added to this emulsion. The results obtained are substantially the same as those obtained with the photosensitive material A.

The following three emulsions are particularly advantageous in cases where relatively high photosensitivity is required.

Use of an emulsion prepared in the presence of a copolymer of acrylamide containing 8-oxyquinoline and N-vinyl pyrrolidone

Photosensitive material C

Preparation of the emulsion

A 0.2% aqueous silver nitrate solution and, immediately afterwards, a 0.17% aqueous potassium bromide solution are tipped while stirring at 40° C. into a 0.1% inert gelatin solution containing 75% of a copolymer of acrylic acid amide and N-vinyl pyrrolidone containing approximately 2% of 8-oxyquinoline. The quantity of potassium bromide used is measured in such a way that a pAg of 9 is obtained. A 10% gelatin solution is then added to solidify the emulsion. The emulsion is then further processed without washing and post-ripening in the same way as the above silver bromide iodide emulsion of the photosensitive material A. The layers have a sensitivity higher by 1 stop than the photosenstive material A.

Use of an emulsion prepared partly by the conversion of silver phosphate

Photosensitive material D

Preparation of the emulsion

The following solutions are prepared:

| | |
|---|---|
| Solution 1: | |
| $H_2O$ | 500 ml |
| gelatin | 0.5 g |
| polymer* | 2.5 g |
| pH | 4.0 |
| Solution 2: | |
| $H_2O$ | 200 ml |
| $AgNO_3$ | 2.1 g |
| Solution 3: | |
| $H_2O$ | 200 ml |
| $Na_2HPO_4$ | 0.75 g |
| Solution 4: | |
| $H_2O$ | 200 ml |
| KBr | 1.45 g |
| NaCl | 0.3 g |
| KI | 0.001 g |
| Solution 5: (allow to swell) | |
| $H_2O$ | 100 ml |
| gelatin | 100 g |

*The "polymer" is polymer No. 4 of German Offenlegungsschrift No. 2,508,279 and U.S. Pat. No. 4152 161.

Solutions 2 to 4 are tipped in rapid succession into solution 1 with vigorous stirring. After digestion for 30 minutes at 40° C. with 4.4 mg of $HAuCl_4$ and 110 mg of $NH_4SCN$, solution 5 is added and the emulsion solidified. The emulsion obtained has an average grain diameter of 0.11 μm, a final pH of 6.2 and a potential $E_{Ag}$ of +65 mV.

The emulsion is processed in the same was as the above silver bromide iodide emulsion of the photosensitive material A, the only difference being that the pH is adjusted to from 5.7 to 5.8 with citric acid. The layers have a sensitivity higher by 2.0 stops than the photosensitive material A.

Use of an emulsion additional containing an iridium compound in contrast to the previous emulsion Photosensitive material E Preparation of the emulsion The procedure is the same as for the above-described emulsion of the photosenstive material D apart from the following differences. 0.006 mg of $Na_2IrCl_6 \times 6\ H_2O$ are introduced into solution 1 two minutes before the beginning of precipitation. After precipitation, 4.4 mg of $KAuCl_4$ and 110 mg of $NH_4SCN$ are added, followed by digestion for 30 minutes. A pH of 6.3 and a potential $E_{Ag}$ of +70 mV are measured. The emulsion obtained is further processed in the same way as the above silver bromide iodide emulsion of the photosensitive material A, the only difference being that the pH is adjusted to from 5.7 to 5.8 with citric acid. The layers have a sensitivity higher by 2.5 stops than the photosensitive material A.

Use of an emulsion containing a cobalt (II)salt

Photosensitive material F

Preparation of the emulsion

The following solutions are prepared:

| | |
|---|---|
| Solution 1: | |
| $H_2O$ | 500 ml |
| gelatin | 0.5 g |
| polymer* (corresponds to the polymer used in material D) | 2.5 g |
| pH | 4.0 |
| Solution 2: | |
| $H_2O$ | 100 ml |
| $Co(NO_3)_2$ | 0.2 g |
| Solution 3: | |
| $H_2O$ | 200 ml |
| $Na_2HPO_4$ | 0.75 g |
| Solution 4: | |
| $H_2O$ | 200 ml |
| $AgNO_3$ | 2.1 g |
| Solution 5: | |
| $H_2O$ | 200 ml |
| KBr | 1.5 g |
| KI | 0.001 g |
| Solution 6: (allow to swell) | |
| $H_2O$ | 100 ml |
| gelatin | 100 g |

Solutions 2 and 3 are added to solution 1 with vigorous stirring, $Co_3(PO_4)_2$ precipitating in fine distribution. Precipitation is allowed to continue for 1 minute at 40° C., after which solution 4 is added and $Co_3(PO_4)_2$ is dissolved in and reprecipitated from $Ag_3PO_4$. This is followed by the conversion of $Ag_3PO_4$ by the halide present in solution 5. After subseuqent digestion for 30 minutes with 4.4 mg of $HAuCl_4$ and 110 mg of $NH_4SCN$, solution 6 is added and the emulsion solidified. The final pH is 6.2. The emulsion is further processed in the same way as the above silver bromide iodide emulsion of photosensitive material A, the only difference being that the pH is adjusted to from 5.7 to 5.8 with citric acid. The layers have a sensitivity higher by 3 stops than the photosensitive material A.

EXAMPLE 4

Addition of "hydrophilic" oil-former emulsates to the emulsion

Preparation of the emulsate 200 g of a 50% solution in diethyl carbonate of compound No. 3 in Table 7 and 100 g of diethyl carbonate are successively dispersed using an intensive stirrer (for example a Kotthoff mixing siren) in 1 liter of a 10% gelatin solution containing 25 ml of a 10% aqueous solution of the sodium salt of di-sec.-butyl naphthalene sulphonic acid as dispergant After stirring for another 5 minutes, the solvent is distilled off in a thin layer evaporator. 1.125 kg of emulsion containing 88.9 g of the oil-former per kg of emulsion are obtained.

Photosensitive material 6.5 g of dye No. 9, Acilan turkey blue B are dissolved in 1 liter of an 8% gelatin solution. 60 ml of a very fine-grained red-sensitised silver bromide iodide emulsion (grain size 0.05 μm) containing 3 mole percent of iodide and having a silver (expressed as silver nitrate) to gelatin ratio of 0.8 and a silver content (expressed as silver nitrate) of 43.65 g/kg of emulsion are then added to the gelatin solution. After the addition of 10 ml of a 1% aqueous sodium lauryl sulphate solution and 73 g of the above emulsion in which 6 g of 1-phenyl-4-hydroxymethyl-4-methyl-3-pyrazolidone had been previously dissolved after melting, the pH is adjusted to from 5.4 to 5.5 with borax solution.

The emulsion is applied to a cellulose acetate support with a silver coating corresponding to 0.25 g of silver nitrate per $m^2$, 7.9 g of gelatin, 0.6 g of dye, 0.65 g of oil-former and 0.6 g of developer substance per $m^2$.

The emulsion layer is hardened and processed in the same way as described in Example 3. The same result as described in Example 3 is obtained both immediately after processing and also after storage for several months. Equally good colour images are also obtained with the other four dyes described in Example 3 both immediately after processing and also after storage for several months. The "hydrophilic" oil-formers improve the stability of the unprocessed material in storage and also the affinity of the material for thermal development.

Similar results are obtained when triphenylphosphate, dinonylphthalate or diisononyl adipate are used as an oil former.

EXAMPLE 5

Addition of the dyes to a layer adjacent the emulsion layer

Photosensitive material 7.5 g of dye No. 9, Acilan turkey blue B, are dissolved in 1 liter of a 7% gelatin solution. After dissolution of the dye, the gelatin solution is applied to a cellulose acetate support with a coating of 7 g of gelatin per $m^2$.

The emulsion described in Example 4 is applied to this dye layer, followed by hardening and further processing in the same way as in Example 4. The vesicle-free blue dye image obtained is as good after storage for several months as it is immediately after processing. Instead of 7.5 g of dye No. 9, 5.5 g of dye No. 33, Astra red 3G, or 5.5 g of dye No. 7, Acilan violet S4BN, or 7.5 g of dye No. 20 may be dissolved in 1 liter of the 7% gelatin solution with equally good results.

Instead of being coated with a red-sensitised emulsion, these dye layers have to be coated with a sensitised emulsion corresponding to the absorption ranges of the dye. It is also possible using the gelatin solution containing dye No. 14 described in Example 3 to obtain a blue dye layer after exposure and rinsing and to use it instead of the dye layer containing dye No. 9.

We claim:

1. A process for the production of positive coloured photographic images by exposing imagewise a photographic material comprising a photosensitive layer containing a photosensitive compound which, as a result of exposure and heat treatment or conventional photographic development, forms nuclei for the imagewise decomposition of hydrogen peroxide, wherein the exposed material containing nuclei for the decomposition of hydrogen peroxide in imagewise distribution is treated with hydrogen peroxide gas and heated in the presence of an oxidisable dye present in the photosensitive layer or in an adjacent or separate layer, the dye being destroyed imagewise over those areas corresponding to the unexposed parts of the photosensitive layer.

2. A process as claimed in claim 1, wherein a photographic material containing photosensitive silver salts in the photosensitive layer is used.

3. A process as claimed in claim 2, wherein at least one silver halide is present in the photosensitive layer.

4. A process as claimed in claim 1, wherein a material of which the binder for the photosensitive layer consists completely or partly of gelatin is used.

5. A process as claimed in claim 1, wherein the exposed material for forming the nuclei for the decomposition of hydrogen peroxide is subjected to a heat treatment in the presence of developer substances.

6. A process as claimed in claim 3, wherein the silver halide expressed as silver nitrate is contained in a quantity of not more than 400 mg/$m^2$ in each silver halide containing layer.

7. A process as claimed in claim 5, wherein the developer is contained in a dispersion containing at least one compound corresponding to the following general formula:

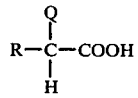

wherein

R represents a saturated or olefinically unsaturated, aliphatic $C_1$–$C_{18}$ hydrocarbon group which may be substituted;

Q represents —COX or —$CH_2$COX wherein X may represent (1) H, OH, alkoxy, cycloalkyloxy, (2) the group —O-alkylene-[O-alkylene]$_n$-O-alkyl wherein n=0–10, (3) an optionally substituted amino, (4) hydrazino or (5) hydroxylamino group, the above-mentioned substituents being in turn substituted or unsubstituted.

8. A process as claimed in claim 1, wherein a photographic material containing the oxidisable dye in the photosensitive layer or in a layer coupled therewith is used.

9. A proces as claimed in claim 1, wherein the exposed layer treated with hydrogen peroxide gas is brought into close contact with a separate, self-supporting or supported layer containing the oxidisable dye at least once and the layers in contact with one another are heated.

10. A process as claimed in claim 1, wherein dyes which, in a concentration of from 0.05 to 1 g per $m^2$ in a gelatin layer containing 8 g per $m^2$ of gelatin, are bleached out when this layer is treated with hydrogen peroxide gas and subsequently heated for from 3 to 20 seconds to from 100° to 150° C. are used.

11. A proces as claimed in claim 1, wherein triphenyl methane dyes, methine dyes or indigoid dyes are used.

12. A photosensitive photographic material containing a dye and at least one photosensitive layer which contains an emulsion of at least one silver halide dispersed in a hydrophilic binder wherein (a) the photosensitive layer contains silver halide comprising silver in an amount in the form of silver nitrate of not more than 400 mg/$m^2$, (b) the grain size of the silver halide grains is less than 0.1 μm, (c) the dye is capable of being bleached out with hydrogen peroxide and (d) wherein said dye is present in the photosensitive layer or an adjacent layer.

13. A material as claimed in claim 12, wherein the binder for the photosensitive layer consists completely or partly of gelatin.

14. A material as claimed in claim 12, wherein the photosensitive layer contains a 3-pyrazolidone.

15. A material as claimed in claim 12, containing a dye which, in a concentration of from 0.05 to 1 g per $m^2$ in a gelatin layer containing 8 g per $m^2$ of gelatin, is bleached out after treatment with hydrogen peroxide gas and heating for from 3 to 20 seconds to from 100° to 150° C.

16. A material as claimed in claim 12, wherein at least one triphenyl methane dye, methine dye or indigoid dye is contained.

17. A material as claimed in claim 12, wherein the photosensitive layer comprises a dispersion containing at least one compound corresponding to the following general formula:

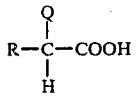

wherein

R represents a saturated or olefinically unsaturated aliphatic $C_1$–$C_{18}$ hydrocarbon group which may be substituted;

Q represents —COX or —$CH_2$COX wherein X may represent:

(1) H, OH, alkoxy, cycloalkyloxy, (2) the group —O-alkylene-[O-alkylene]$_n$-O-alkyl wherein n=0–10, (3) an optionally substituted amino, (4) hydrazino or (5) hydroxylamino group, the above-mentioned substituents being in turn substituted or unsubstituted.

* * * * *